US007780573B1

(12) United States Patent
Carmein

(10) Patent No.: US 7,780,573 B1
(45) Date of Patent: Aug. 24, 2010

(54) OMNI-DIRECTIONAL TREADMILL WITH APPLICATIONS

(76) Inventor: David E. E. Carmein, 1219 Van Dusen Dr., Ann Arbor, MI (US) 48103

( * ) Notice: Subject to any disclaimer, the term of this patent is extended or adjusted under 35 U.S.C. 154(b) by 297 days.

(21) Appl. No.: 11/700,410

(22) Filed: Jan. 31, 2007

Related U.S. Application Data

(60) Provisional application No. 60/763,541, filed on Jan. 31, 2006.

(51) Int. Cl.
*A63B 24/00* (2006.01)
*A63B 22/02* (2006.01)

(52) U.S. Cl. ..... 482/4; 482/54

(58) Field of Classification Search ..... 482/4, 482/5, 6, 7, 51, 54, 57, 69, 900, 904, 1, 2, 482/3; 119/700; 193/35 MD; 198/370.06, 198/370.1, 371.2
See application file for complete search history.

(56) References Cited

U.S. PATENT DOCUMENTS 3,451,526 A 6/1969 Fernandez
3,550,756 A 12/1970 Kornlak et al.
3,675,640 A * 7/1972 Gatts ..... 600/484
4,223,753 A * 9/1980 Bradbury ..... 180/6.2
4,925,183 A * 5/1990 Kim ..... 482/61
4,938,473 A * 7/1990 Lee et al. ..... 482/54
D318,791 S * 8/1991 Guile ..... D8/375
5,186,270 A 2/1993 West
D340,342 S 10/1993 Nummelin et al.
5,314,391 A 5/1994 Potash et al.
5,330,401 A * 7/1994 Walstead ..... 482/54
5,385,519 A * 1/1995 Hsu et al. ..... 482/54
5,385,520 A * 1/1995 Lepine et al. ..... 482/54
5,411,279 A * 5/1995 Magid ..... 280/47.38
5,470,293 A * 11/1995 Schonenberger ..... 482/54
5,474,087 A * 12/1995 Nashner ..... 600/595
5,490,784 A 2/1996 Carmein
5,538,489 A * 7/1996 Magid ..... 482/54
5,562,572 A 10/1996 Carmein
5,577,981 A * 11/1996 Jarvik ..... 482/4
5,607,376 A * 3/1997 Magid ..... 482/54
5,662,560 A * 9/1997 Svendsen et al. ..... 482/69
5,980,256 A 11/1999 Carmein
6,042,514 A * 3/2000 Abelbeck ..... 482/54
6,123,647 A 9/2000 Mitchell
6,135,928 A * 10/2000 Butterfield ..... 482/69
6,146,315 A * 11/2000 Schonenberger ..... 482/69
6,152,854 A 11/2000 Carmein
6,273,844 B1 * 8/2001 Kelsey et al. ..... 482/54
6,301,582 B1 10/2001 Johnson et al.
6,315,109 B1 * 11/2001 Dean ..... 198/786
6,348,025 B1 * 2/2002 Schonenberger ..... 482/54
6,409,633 B1 * 6/2002 Abelbeck ..... 482/54

(Continued)

*Primary Examiner*—Loan H Thanh
*Assistant Examiner*—Daniel F Roland
(74) *Attorney, Agent, or Firm*—Richard John Bartz

(57) ABSTRACT

A treadmill having a track assembly that allows a user to navigate in any arbitrary direction. A movable user support has a plurality of rotatable members that rotate about axes normal to the direction of movement of the user support. Separate power drive mechanism concurrently move the user support and rotate the members to omni-directional user movement. A control for the power driven mechanism is responsive to the directional orientation of the user on the user support to cause the user support to operate in the direction of the orientation of the user.

34 Claims, 9 Drawing Sheets

U.S. PATENT DOCUMENTS

| | | | | |
|---|---|---|---|---|
| 6,624,853 | B1 | 9/2003 | Latyov | |
| 6,669,012 | B1 * | 12/2003 | Yoshida et al. | 198/890 |
| 6,743,154 | B2 | 6/2004 | Epstein | |
| 6,821,233 | B1 | 11/2004 | Colombo et al. | |
| 6,854,584 | B2 * | 2/2005 | Henson et al. | 198/370.06 |
| 6,857,707 | B2 * | 2/2005 | Guile | 301/5.23 |
| 6,916,273 | B2 | 7/2005 | Couvillion, Jr. et al. | |
| 7,038,855 | B2 * | 5/2006 | French et al. | 359/630 |
| 7,101,318 | B2 * | 9/2006 | Holmes | 482/54 |
| 7,255,666 | B2 * | 8/2007 | Cardenas | 482/143 |
| 7,318,628 | B2 * | 1/2008 | Guile | 301/5.23 |
| 7,331,906 | B2 * | 2/2008 | He et al. | 482/69 |
| 7,381,163 | B2 * | 6/2008 | Gordon et al. | 482/69 |
| 7,387,592 | B2 * | 6/2008 | Couvillion et al. | 482/8 |
| 7,470,218 | B2 * | 12/2008 | Williams | 482/51 |
| 2002/0022554 | A1 * | 2/2002 | Borsheim | 482/54 |
| 2004/0005962 | A1 * | 1/2004 | Borsheim | 482/54 |
| 2004/0097330 | A1 * | 5/2004 | Edgerton et al. | 482/1 |
| 2004/0106504 | A1 * | 6/2004 | Reiffel | 482/54 |
| 2004/0143198 | A1 * | 7/2004 | West | 601/5 |
| 2004/0147369 | A1 * | 7/2004 | Jimenez Laso | 482/8 |
| 2005/0101448 | A1 * | 5/2005 | He et al. | 482/54 |
| 2005/0148432 | A1 * | 7/2005 | Carmein | 482/8 |
| 2005/0233865 | A1 * | 10/2005 | Reiffel | 482/54 |
| 2005/0266963 | A1 * | 12/2005 | Holmes | 482/54 |
| 2006/0052728 | A1 * | 3/2006 | Kerrigan et al. | 600/595 |
| 2006/0122035 | A1 * | 6/2006 | Felix | 482/8 |
| 2006/0128532 | A1 * | 6/2006 | Wang | 482/54 |
| 2006/0229167 | A1 * | 10/2006 | Kram et al. | 482/54 |
| 2006/0247104 | A1 * | 11/2006 | Grabiner et al. | 482/54 |
| 2007/0270285 | A1 * | 11/2007 | Gill et al. | 482/54 |
| 2008/0020907 | A1 * | 1/2008 | Lin | 482/54 |

* cited by examiner

OMNI-DIRECTIONAL TREADMILL WITH APPLICATIONS

CROSS REFERENCE TO RELATED APPLICATION

This application claims the priority benefit of U.S. Application Ser. No. 60/763,541 filed Jan. 31, 2006.

FIELD OF THE INVENTION

The invention is in the field of omni-directional treadmills and virtual reality systems that allows a user to walk or run in any arbitrary direction and employing haptic sensing for users' immersion in a simulated environment.

BACKGROUND OF THE INVENTION

An Omni-Directional Treadmill ("ODT") has proved its usefulness, especially when combined with a computer-generated, immersive graphics display. Such a combination permits a person to walk, run, or crawl on the treadmill while reacting to the visuals. Thus, the immersed person is able to navigate the virtual environment created by the computer in a way that is natural and easy to learn.

Previous ODT designs, disclosed by D. E. E. Carmein in U.S. Pat. Nos. 5,562,572 and 6,152,854 have shown the advantages of an ODT-based simulation system. Besides detailing various construction methods for these devices, these patents revealed novel and useful combinations of the ODT with various complementary components.

Earlier ODT designs had many parts, thus making manufacturing expensive and mechanical failure more likely. The more recent belt-based design has fewer parts and provides for a high velocity, highly dynamic device suitable for fast maneuvers and rapid speed. The penalty for a high-performance device is, again, high cost due to high forces. Need for higher-strength parts increases weight, which in turn increases the amount of power to effectively drive a system.

A typical configuration of the belt-based ODT design is disclosed in FIG. 19 of U.S. Pat. No. 6,152,854. The omni-directional treadmill is comprised of adjacent mini-treadmills or minisegments. Segments loop around the ends and meet at the bottom to form a complete circuit. The active surface is driven in the Y direction by one servomotor and in the X direction by another servomotor, and provides infinite omni-directional and bidirectional motion to a person navigating thereon.

A. Mitchell in U.S. Pat. No. 6,123,647 employs a side driver spline that engages teeth extending form each minisegment. This apparatus is expensive and difficult to execute because of the need for high tolerance and a synchromesh. The X drive actuation is challenging due to the nature of motion around the ends of the X circuit. A single attachment point drive for the minisegments causes the surfaces of the minisegments to instantaneously accelerate and decelerate as the minisegments enter and leaves the end return circuits.

Any ODT construction must actuate the Y belts in some manner. Any design that allows the Y belts to de-actuate and slow or stop must then drive them up to speed again as they re-engage the Y drive mechanism. This re-engagement causes both friction and noise, and under certain circumstances, it will compromise the desired surface velocity characteristics because the Y velocity will not achieve the desired speed.

ODT surface control schemes that employ position sensing to keep the user centered are inherently velocity limited because viable control schemes based on washout, or more simply, PID-type control, require space around the center for error to be generated. Once under speed, the user indicates additional velocity change by moving in the desired direction. A user already at the edge of the active surface may then be prevented from further movement towards the edge, and thus prevented from higher velocities. Highly dynamic movements may easily place the user next to an edge under these conditions. In general, the higher the desired speed, and the higher the accelerations, the larger the ODT surface must be. This is an inherent limitation of position-based control.

Existing ODT applications have done little to enrich the user's immersive physical environment. The invention proposes numerous devices and methods to enrich the user's physical experience.

Use of the ODT as a premium interface to immersive virtual worlds is uncharted territory. The current invention proposes several useful and interesting applications.

SUMMARY OF THE INVENTION

The present invention is directed to an ODT, apparatus and method that functions in coordination with a computer-generated simulation to provide natural ambulatory motion, sound, and haptic experiences within the simulation. The ODT has a track assembly with an omni-directional user surface on a belt apparatus having side-by-side transverse endless belts movable in a Y direction. The adjacent transverse endless belts are operatively connected to provide a longitudinal endless belt trained around a transverse end roller and drive sprockets engageable with link chains connected to opposite ends of the support for the transverse endless belts. The connected transverse belt coupler assures proper belt actuation and indexed Y movement at the ends of the X movement circuit. The couplers include at least two pivot members connected to the endless link chains whereby the transverse belts continue to move as they turn around the opposite longitudinal ends of the track assembly. A reversible electric motor coupled to the drive sprockets operates to selectively move the longitudinal endless belt in opposite longitudinal directions as determined by the user on the user surface or a computer program. Each transverse endless belt has a Y drive device operable to selectively move the transverse belts in opposite Y directions whereby they are not instantaneously accelerated when they move in the user surface position. This permits higher belt speeds. Each of the transverse belts is trained around a rigid box member having a low friction upper surface or bed providing a guide for the transverse belt and a rigid support for the user's weight. One embodiment of the Y drive device employs an omni-wheel located in frictional engagement with the transverse belt to move the belt in selective Y directions. Another embodiment of the Y drive device includes a reversible electric motor coupled to the transverse belt to move the belt in selective Y directions.

The present invention is also directed to a harness apparatus working in concert with the ODT to provide functions such as force control, position control, haptic whole-body feedback, free-body flight, and safety.

The present invention is also directed to an apparatus that works in concert with the ODT and immersive simulation to provide haptic feedback of a variety of types, including but not limited to: sitting, opening doors, keyboarding, swordplay, gunplay, light sabers, flashlights, and anthropomorphic human analogs with optional robotic actuation.

The present invention is also directed to an apparatus that provides the impression of heat and/or air movements.

The present invention is also directed to an ODT apparatus that functions in coordination with a remote mobile device to transmit the user's natural ambulatory motion to the remote device for steering.

The present invention is also directed to an ODT apparatus that functions in coordination with a remote mobile device to transmit sound from or to/from the remote device.

The present invention is also directed to an ODT apparatus that functions in coordination with a remote mobile device to link actuators on the remote device to haptic devices incorporated into the user environment of the ODT apparatus. The present invention is directed to a method employing the ODT apparatus for physical rehabilitation.

The present invention is directed to a method employing the ODT apparatus for psychological rehabilitation.

The present invention is directed to a method employing the ODT apparatus for training: military, home defense, sports, security, emergency responder, police, firearms.

The present invention is directed to a method employing the ODT apparatus for entertainment.

The present invention is also directed to an ODT apparatus for motion capture.

The present invention is also directed to an ODT apparatus for real-time entertainment content generation.

The present invention is also directed to an ODT apparatus for real-time entertainment participation.

The present invention is also directed to a method employing the ODT apparatus for business.

The present invention is also directed to a method employing the ODT apparatus for sports, both existing and based on ODT capabilities.

The present invention is also directed to a method employing the ODT apparatus for creating and experiencing persistent AI entities.

The present invention is also directed to methods employing the ODT apparatus for design.

The present invention is also directed to a method employing the ODT apparatus to expand the impression of a physical living space.

The objects of the ODT apparatus and method of the invention embodied in the disclosed treadmill belt track and associated structures include but not limited to (1) providing belt drive mechanisms having a minimum of precision parts and a relatively low cost without splined synchromesk belt drives, (2) providing a drive device that simultaneously operates all transverse belts in a smooth, continuous and controllable manner, and (3) providing an ODT with a user harness to optionally connect the user to a control and a safe operational environment.

Another object of the present invention to link the forces expected in the user's virtual world to forces experienced on an ODT-based simulator.

Another further object of the present invention to harness the user so that s/he may be lifted up to simulate free-body flight.

Another object of the present invention to provide mounting locations for input devices that enhance the user's physical experience.

Another object of the present invention to provide mounting locations for output devices that sense some aspect of the user's experience.

Another object of the present invention to provide a rigid frame for physical grounding that moves with respect to the user's rotary frame of reference.

Another object of the present invention to actuate Y belt motion using individual electric motors.

Another object of the present invention to provide a means of tipping the ODT surface so that the user is navigating a non-level surface.

DETAILED DESCRIPTION OF THE INVENTION

Figure 1:
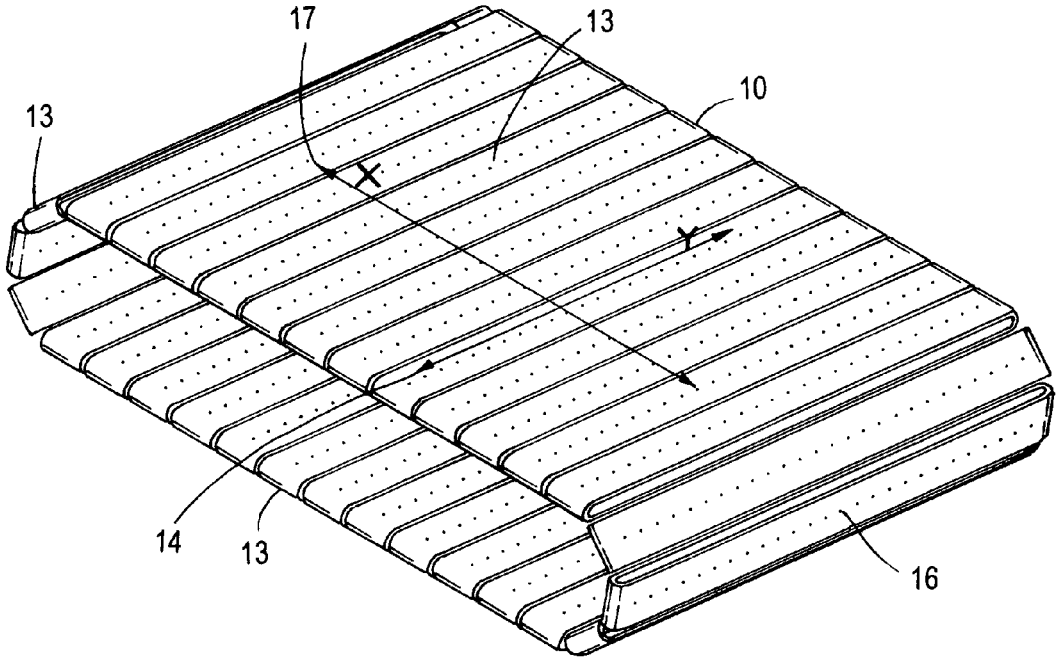
FIG. 1 is a perspective view of an omni-directional treadmill track apparatus with belts moveable in X and Y directions.

In the following detailed description of the omni-directional treadmill and its applications, reference is made to the drawing that forms a part thereof, and which describe and show specific embodiments in which the invention can be practiced. It is to be understood that other embodiments can be utilized and structural changes can be made by persons skilled in the art without departing from the scope of the invention.

A track assembly 10 of the invention, shown in FIG. 1, is part of an omni-directional treadmill that allows a user, such as a person or animal to move, walk, run or crawl in any arbitrary direction. An example of an omni-directional treadmill is disclosed by D. E. E. Carmein in U.S. Pat. No. 6,152,854 and incorporated herein by reference. Track assembly 10 has a plurality of side-by-side endless transverse belts 13 or transverse treadmill segments simultaneously moved in selective opposite transverse or Y directions shown by arrow 14. Adjacent transverse belts are mounted on supports coupled together to provide a longitudinal endless belt 16 movable in selective opposite longitudinal directions shown by arrow 17. The belts 13 and 16 are uniformly and simultaneously actuated in both transverse and longitudinal directions with separate drive mechanisms.

Omni-Wheel Actuated Y Belt Drive Mechanism

Figure 2:
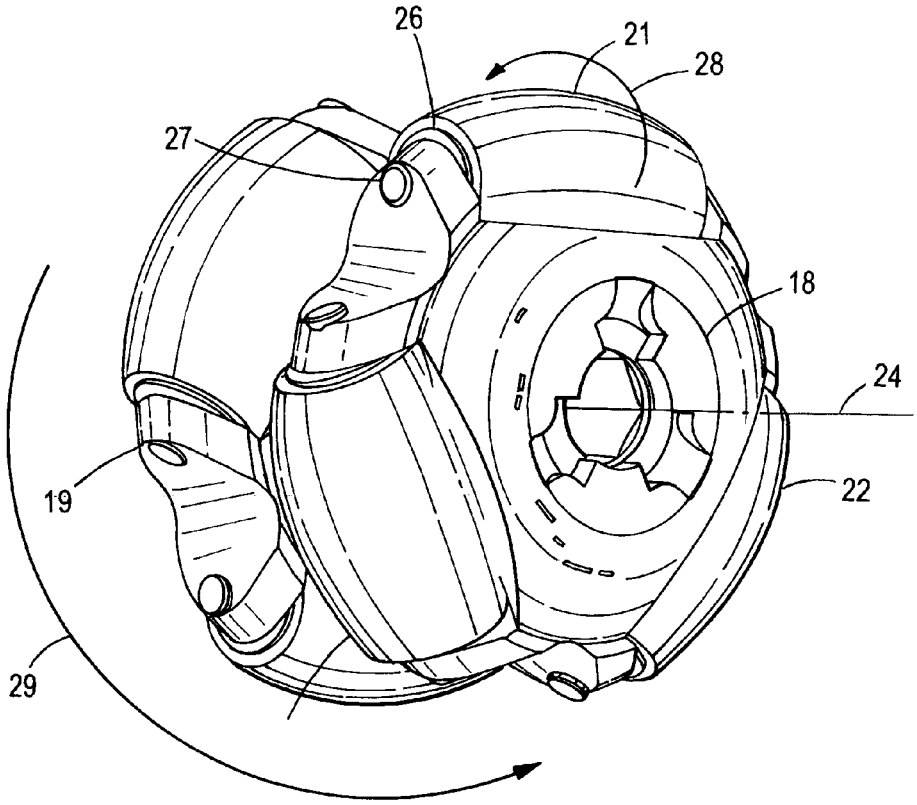
FIG. 2 is a perspective view of an omni-wheel for moving the transverse belts of the track apparatus of FIG. 1.

FIG. 2 depicts an omni-wheel 18 known as a vector slip drive, mounted adjacent to another 19. As depicted, three barrels 21, 22, 23 are arranged radially about an axis 24. Each barrel is mounted with bearings 26 on an axis 27 and is free to rotate as shown by arrow 28. The paired omni-wheel assembly is free to rotate, shown by arrow 29, about the central axis 24. An omni-wheel pair has been shown as an effective means of frictionally engaging a surface to drive it in one preferred direction, and which passes through motion from the other axis. In operation, individual barrels 21, 22, 23 are free to pass motion parallel to the central axis 24, and can be driven about central axis 24 to impart a frictional drive force to an object contacting barrels 21, 22, 23.

A linear bank of wheels 18, 19 can be placed under a layer of belts 13, and used to drive the belts simultaneously in the preferred direction. Said bank of wheels 18, 19 preserves the function of a wheel pair: it drives multiple mini-segments simultaneously in one axis while appearing mechanically transparent to the other axis' motion.

Figure 3:
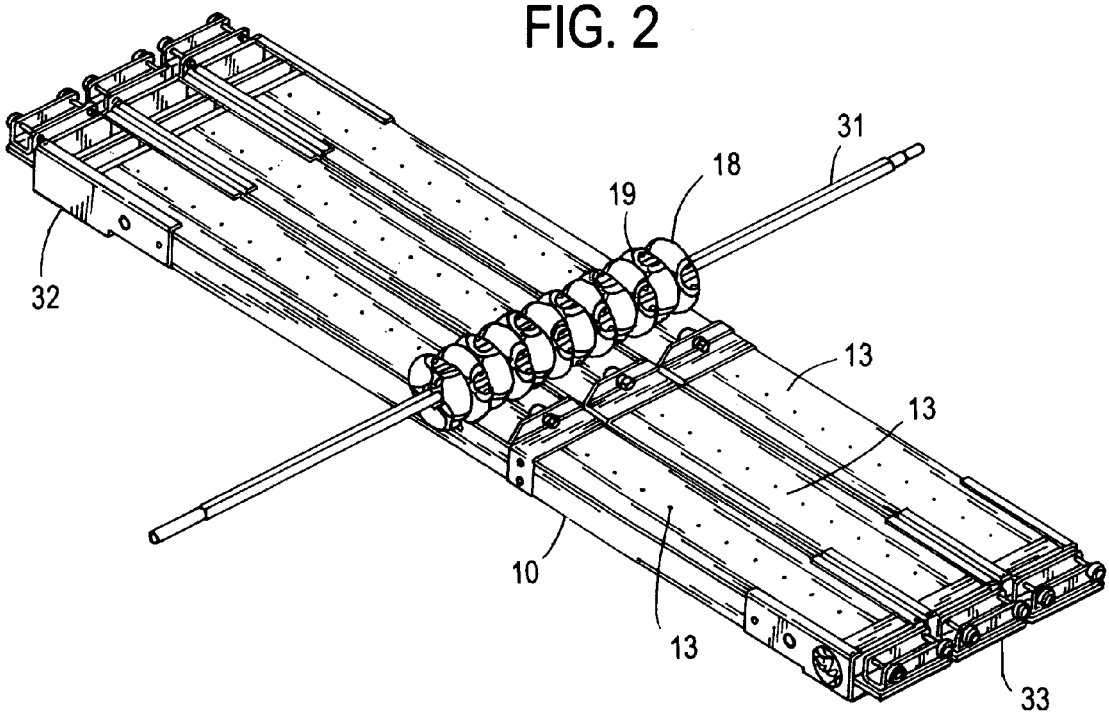
FIG. 3 is a perspective view of omni-wheels located in driving engagement with a group of transverse belts.
Figure 4:
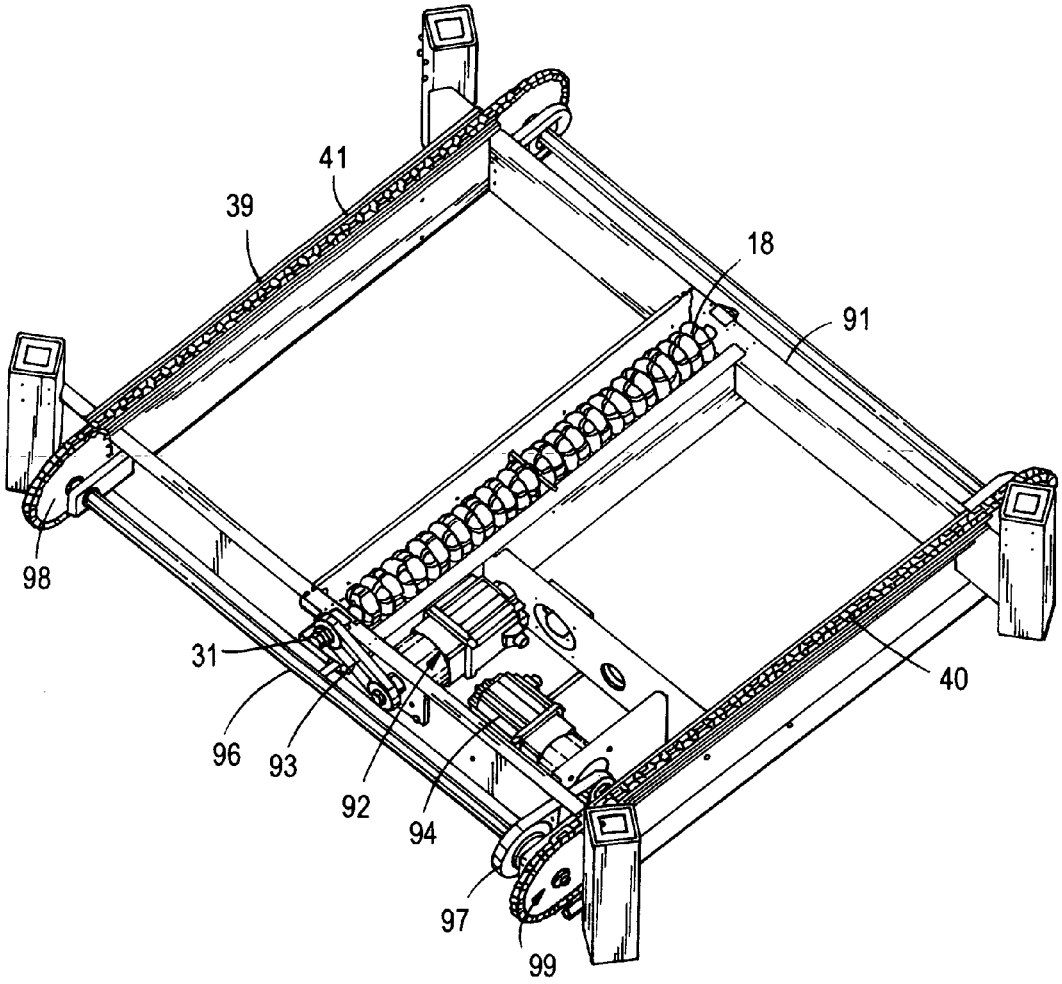
FIG. 4 is a perspective view showing the drive mechanisms for the transverse and longitudinal belts.

FIG. 3 shows a bank of omni-rollers engaged in a drive of this type. We see in the figure a group of 3 wheels 18, 19 engaged on their underside of belts 13 by a bank of paired omni-wheels 18, 19. Omni-wheels 18, 19 are actuated about a drive shaft 31, causing the belts 13 to move in a circuit about their ends 32, 33, thus motivating the Y drive means of FIG. 1. As shown in FIG. 4, the bank of omni-wheels 18 extends longitudinally along the middle of the treadmill frame 91. A reversible drive electric motor 92 mounted on frame 91 is drivably connected to shaft 31 with a belt and pulley power transmission 93 to rotate shaft 31 and bank of omni-wheels 18 thereby transversely moving all the transverse belts 13 together in selective Y directions. Motor 92 is wired to a controller or computer program that operates the track assembly 10. A second electric motor 94 mounted on frame 91 is drivably connected to a transverse shaft 96 with a belt and pulley power transmission 97. Sprockets 98 and 99 secured to opposite ends of shaft 96 engage chains 39 and 40 to move chains 39 and 40 and transverse belts 13 in the X direction. Motor 94 is also wired to the controller that operates track assembly 10. The advantage of this drive mechanism is that Y motion can be transferred to the transverse belts 13 while the X axis is in motion, while being completely transparent to X motion. X and Y motions can thereby operate with complete independence. In addition, omni-wheels are relatively simple compared to other drive mechanisms for transverse belts 13.

Actuation of Belts in Y Direction Around Ends

Figure 5:
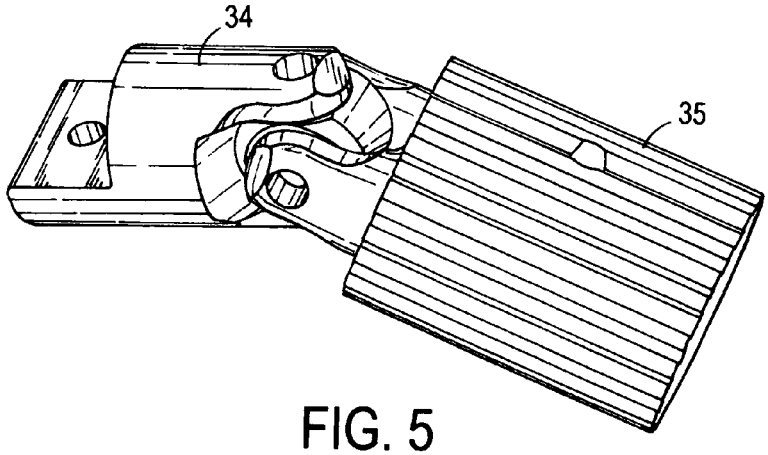
FIG. 5 is a perspective view of a U-joint coupling.
Figure 6:
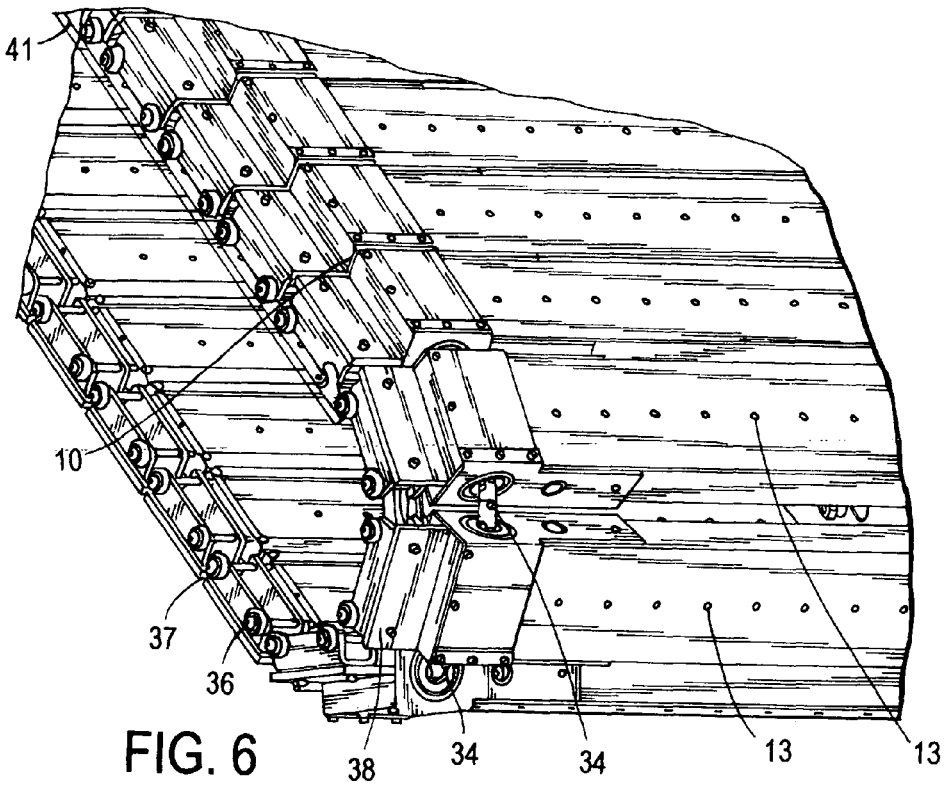
FIG. 6 is a perspective view of an end section of the track apparatus of FIG. 1.

As the transverse belts 13 travel around the end circuits of the X direction belt, the transverse belts must be driven at the same speed as the top and bottom planes. Driving them at the same velocity ensures drive speed continuity when the returning segments re-engage the drive system. FIG. 6 shows belts 13 as they approach the X end circuit. The invention connects adjacent belts 13 through a common drive using a coupling 34 of sufficient strength and flexibility. The coupling must be able to transmit torque while being bent, rotated, and extended. Couplings collapse back into the end rollers 35 once they traverse their X return circuits. At least three coupling types meet this requirement: 1) U-joint, 2) CV joint, or 3) flexible coil. In addition to being flexible, coupler 34 must also permit sliding along the drive axis. This is because a gap is formed between belts 13 as they go around the ends. The coupling must extend to fill this gap while at the same time conveying torque. Most commonly the coupling provides the bending and torque transfer functions while a slider mechanism 35, like a spline, provides linear extension. U-joint coupler 34, shown in FIG. 5, has a slider mechanism 35.

End Pivot Mounted Minisegments for Continuous End Motion

Figure 7:
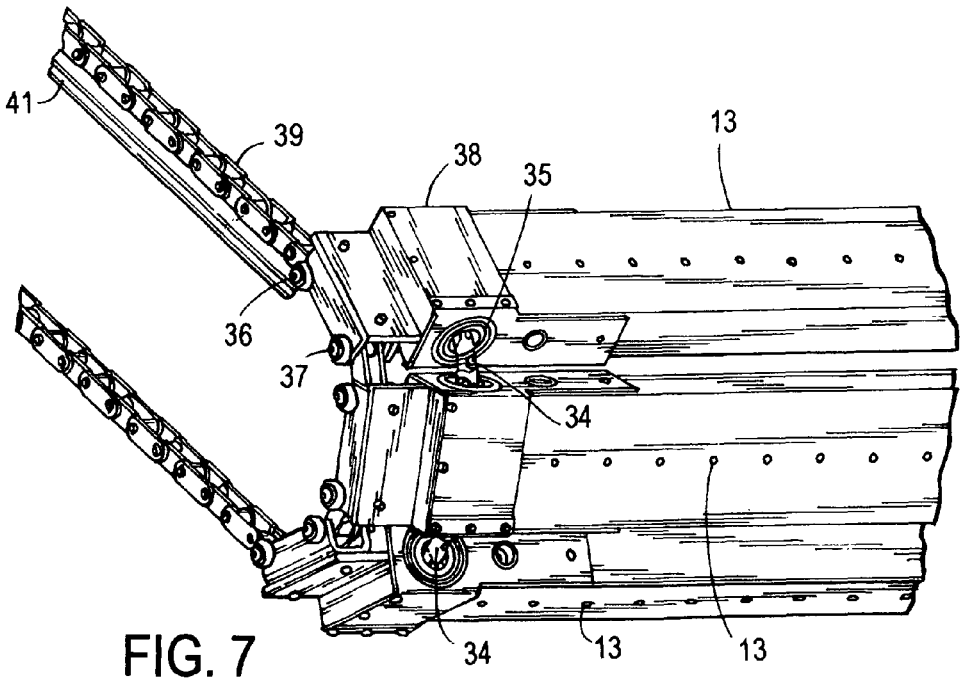
FIG. 7 is an enlarged perspective view of the end section of the track apparatus of FIG. 6.

FIGS. 6 and 7 depict a means of mounting adjacent belts 13 through pivot members 36 and 37 located at the ends of belt support 38. The pivot members 36 and 37 are mounted to a linear drive means such as a chain 39 or flexible belt that rides on a rail 41 joined to frame 91. As shown, the pivot members 36 and 37 are pins that pass through the chain flexures. Two pivot members per end provide torque for rotating the segment as well as stability in the directions of motion. The preferred mounting locations are at pivot pins that correspond as closely as possible to the bottom of support 38. Said pins provide structural support for belt 13 and load, actuate support 38 in the linear and rotary modes, and as a force couple provide the torque for twisting support 38 around its end circuits. It is necessary that one of the two pins provide means for sliding in order to account for the shortening of the chain or belt mounting distance as it arcs around the X end circuits. The sliding attachment may also take the form of a flexure, articulated joint, or linearly compliant mount. In X motion, the leading pin X circuit rotation, with support 38 fully rotating once the trailing pin hits the end circuit. As belt 13 travels around the end it is held in place by the pins, and begins rotational deceleration as it hits the bottom of the circuit, as with belt 13. End mounted, dual pin-engaged support 38 thus experience continuous motion as they enter and complete their X circuit rotations.

Linear X Chain or Belt Drive

One way to actuate the X axis, which is comprised of multiple transverse belts 13, is to employ chains 39, 40, as depicted in FIGS. 4, 6 and 7. The supports 38 are optionally attached to the chains through special tabs attached to chains 39, 40, or by putting the pivot/members through the hollow pins of the chain, as shown. Another X actuation means is to employ a flexible belt, preferably of the toothed type, wherein dual pivot mounts are provided to support 38. Because the end of support 38 is rigid and holds its linear dimensionality while the linear drive means must curve around a sprocket, the mounting distance on support 38 does not match the mounting distance on the linear drive means when units are traversing the end circuit. At least one of the mounts must effectively be a slider while the other one is fixed. This is easily accomplished by mounting the cross pin in a slot or by mounting on a flexible assembly such as a spring clip or a hinge.

Centroid Harness for Safety, Force-Feedback, Lifting

This ODT embodiment includes the provision for harnessing the user to a moveable ground. A harness of this type increases safety, facilitates a smaller active surface area by restricting lateral movement, can substitute for missing inertial and work functions, and even lift the user to provide the illusion of free-body flight. Initial work on combining a harness with an ODT began in 1997 with the creation of the first integrated system by D. E. E. Carmein in U.S. Pat. No. 5,562,572 titled "Omni-directional treadmill." While a non-contact ODT interface is useful, harnessing the user to provide partial or full body support has additional benefits. A harness can provide force substitutes for inertial cues, loading for hills and stairs, and generally control work functions performed by the user. For entertainment, the harness can lift the user up from the ODT surface, thus providing the impression of free flight. It is straightforward to read the force signals from the control loop and convert them into work functions for the individual. Obvious applications include measurement of energy expenditure, force loading for realistic exertion during training, and physical exertion with measurement and analysis during simulated sports activities.

Figure 9:
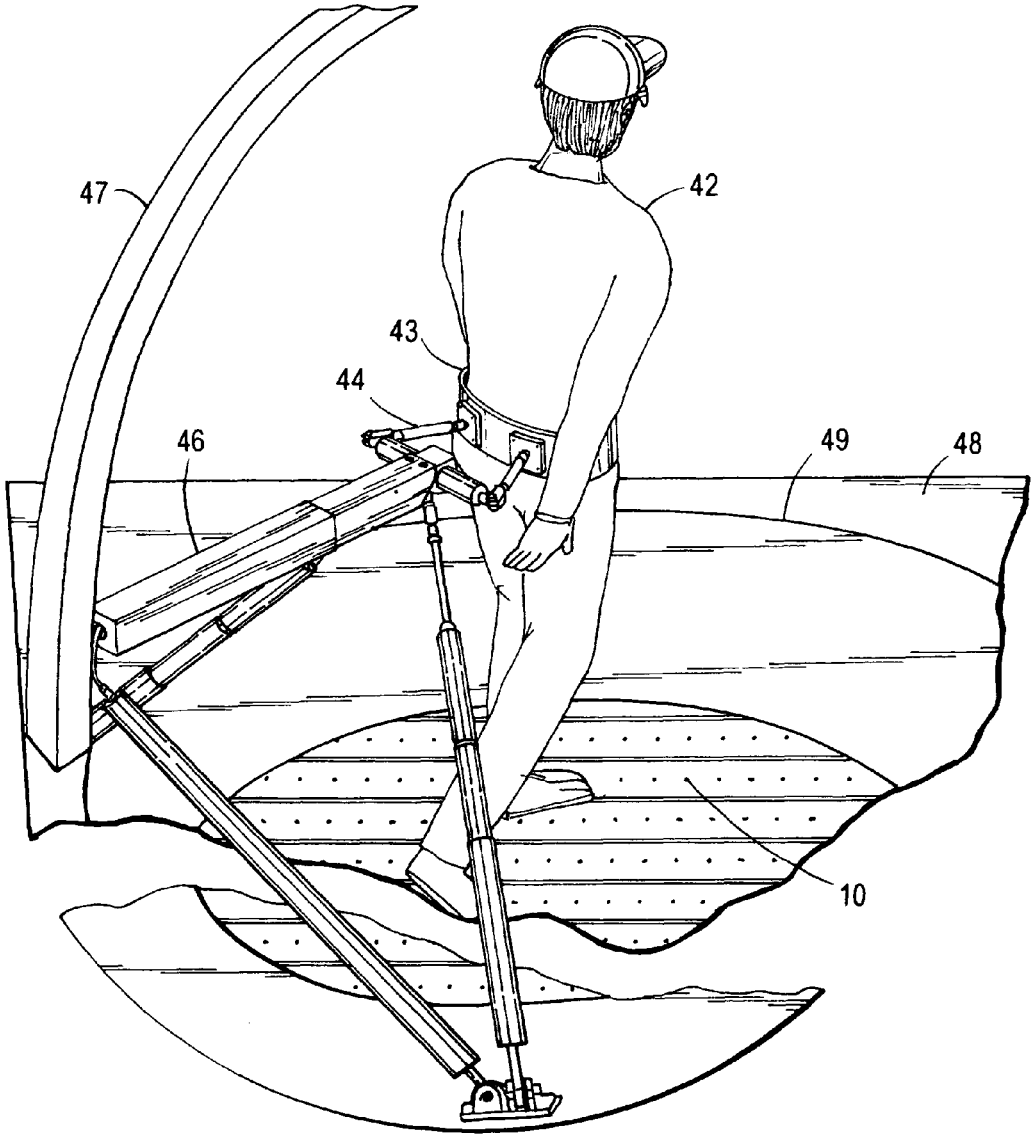
FIG. 9 is a perspective view of an immersive simulator employing the track apparatus of FIG. 1.

FIG. 9 depicts a user 42 walking on the omni-directional surface of track assembly 10, held at center by a mid-waist harness 43. The harness forms one bar of a 4-bar linkage 44 that provides a center of rotation roughly corresponding to the centroid of the user. Linkage 44 is connected to an actuator assembly 46 and provides all required degrees of freedom, sensing, and actuation. The harness actuator assembly is optionally fastened to a rigid canopy bar 47 for suitable positioning and anchoring. Bar 47 is mounted on a base frame 48 supporting a rotary frame 39. The harness 43 ensures safety, position restriction, and planar force feedback. A more advanced harness will have leg straps, and additionally a chest strap that will enable full-body lifting. The lifting force, normal to the plane of the ODT, may be provided by the canopy bar 47. FIG. 9 also reveals three actuators that control force through the centroid of the user. It is within the scope of this invention to have one or more actuators. It is also within the scope of this invention to have actuators that are simply springs, spring-dampers, or fully controlled linear servo devices.

Force Controlled Active Surface

To date, control schemes for omni-directional surface control have focused on position error to keep the user centered. For harness-based interaction a preferred control scheme is to employ the natural forces generated by the user against the harness to control the surface. This approach most closely mimics how people navigate in the real world. We must continually adjust our energies against the forces of inertia during stopping and starting, and against slope, as we climb or descend. This invention proposes employing the centroid harness to modulate ODT surface activity by sensing user force against the harness and generating the appropriate surface response. Looking to Newton's equations of motion, where $F=m\times a$, we see that the acceleration force (a) multiplied by the user's mass (m) results in the force (F) required to move that mass. On a treadmill, acceleration is close to zero, and thus the user experiences no acceleration force. We can input force to the user by creating a force couple between the user's feet and the center of force of the harness. Viewed from the other direction, a user can create a force in the harness that is countered by the shear force on their feet. In the process, the user must lean into the harness to counteract the torque caused by this couple. We observe that this leaning and force couple are directly analogous to the force-moment couple we experience in the real world when stopping and starting. By closing the ODT surface control loop around force instead of position, we can effect a control scheme that more closely matches the real world in terms of its effect in the user. Simply put, as the user creates a force in the harness, the ODT surface either speeds up or slows down accordingly. When the user encounters a slope in the virtual world, surface velocity will zero out when the user experiences shear force scaled to the shear force they would experience on an equivalent slope. The scaling factor need not be 1. Work functions may also be created for the user according to $W=f\times d$, or work (W) equals force (f) times distance (d). Also, $P=f\times v$, or power (P) equals force times velocity (v). Since the ODT can modulate force and distance, or force and velocity, these work functions are fully controllable.

Servomotor-Controlled User-Mounting Frame and Generic Sensory Apparatus Mounts

Figure 10:
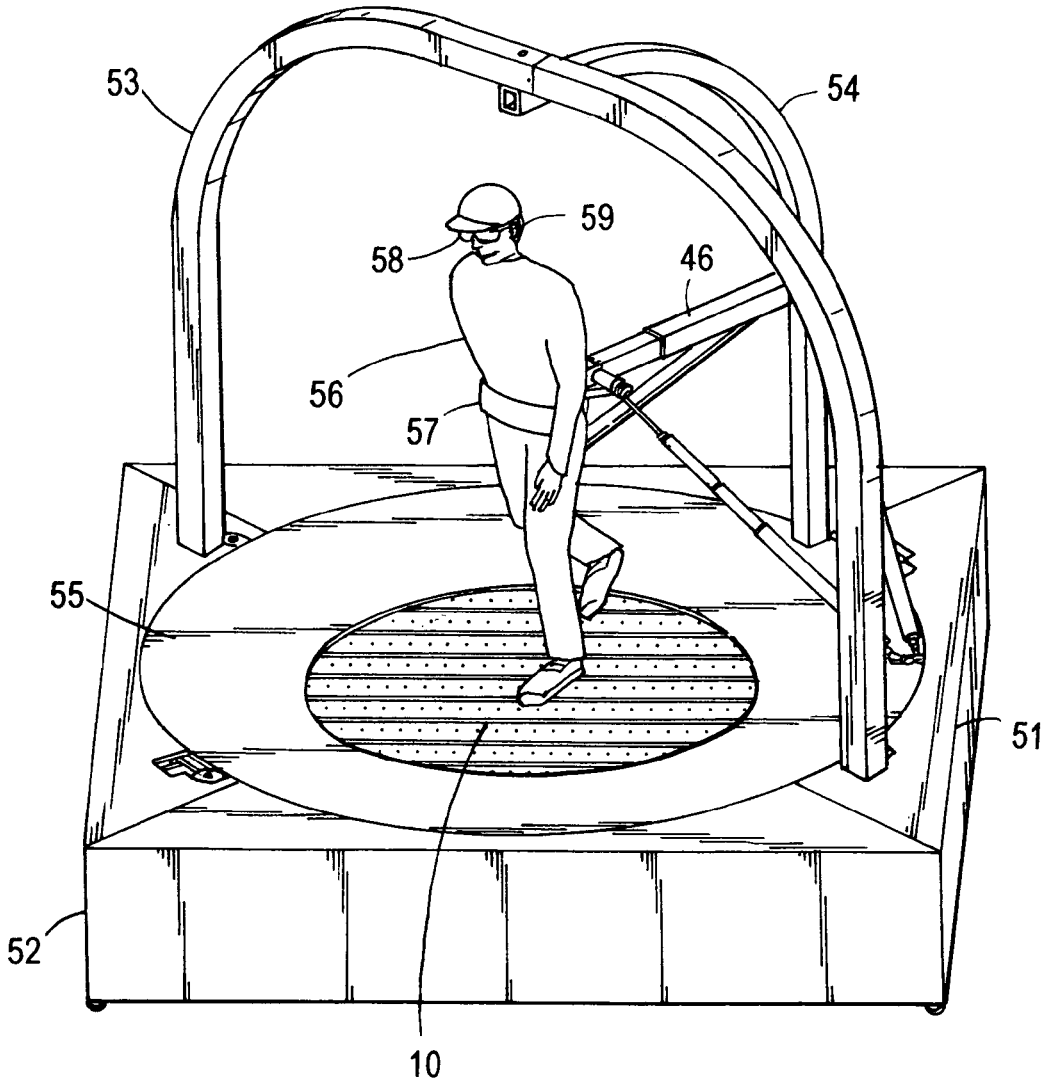
FIG. 10 is a perspective view of an immersion simulator with a user navigating on the omni-directional active surface of the track apparatus of FIG. 1.

FIG. 10 shows a complete immersive simulator 51 including a base frame 52 encloses an omni-directional treadmill 10. A canopy frame 53 provides an upper mounting reference and stays fixed with respect to global ground. A rotary frame 55 pivots about the center axis in response to the user's rotational position, and forms a rigid reference for the user ground. The canopy bar 54 rigidly connects with the rotary frame 55 and the center of the canopy frame 54, and is positioned to always be directly behind the user 56. The user harness 57 connects the user to user ground through the canopy bar and the rotary frame. A head-mounted display 58 with ear buds provides visuals and sound. The rotary frame 55 and its related structures are rotated under a servomotor control about the center axis of the active ODT surface. This motion is slaved to the user's rotary position through the harness or an equivalent means, like non-contact sensing. Said rotary frame operates in the user's reference coordinates so that the frame is substantially positioned to be fixed with respect to the user's body coordinate system. When the user rotates, the rotary frame rotates with him/her, so that the canopy bar always stays directly behind the user 56. The rotary frame 55 and canopy bar 54 are grounded mounting structures for addition of other sensory apparatus means. Generic sensory stimulation mounts will have mechanical fastening means as well as power and signal jacks.

Useful mechanisms and interactive solids may include but are not limited to:

- Horizontal pad for sitting;
- Standard keyboard and mouse combination;
- Sword hilt, which is itself servo controlled to give the impression of mass, force and impact feedback from combat;
- Mechanical human hand, textured and articulated, heated and sensor laden to simulate the touch of another human;
- Soccer ball or other sport element;
- Lifting actuator to lift the user and simulate free-body flight;
- Aircraft cockpit assembly;
- Automotive console assembly;
- Doorknob or door handle;
- Fan;
- Scent generator; and
- Motion capture means.

These elements compliment the user's immersive experience by providing haptic and/or tactile feedback to what the immersant is seeing. Active and passive interactive solids are described by D. E. E. Carmein in U.S. Pat. No. 5,490,784, "Virtual reality system with enhanced sensory apparatus." Said generic mounting schemes enable haptic elements in either class to secure grounding reactive force to counteract haptic forces imposed by the user. Useful haptic interaction with non-grounded objects such as tracking mice, drinking glasses, and food, presents a special class of passive interactivity. Those familiar with the art of VR are aware of "augmented reality", wherein virtual objects are superimposed on the real world. Likewise, objects from the real world can be pulled into the virtual world so that there is good correspondence between the observed and the sensed. One method of scanning and co-locating scanned objects with virtual objects is described by D. E. E. Carmein in U.S. Patent Application No. 20050148432. This "augmented virtual reality", or AVR, permits a person immersed in a simulation to interact with free physical objects in their environment. AVR, in combination with grounded components such as those described herein, will permit a user to use a computer mouse, or have a drink and a meal with a likewise-networked individual.

Figure 8:
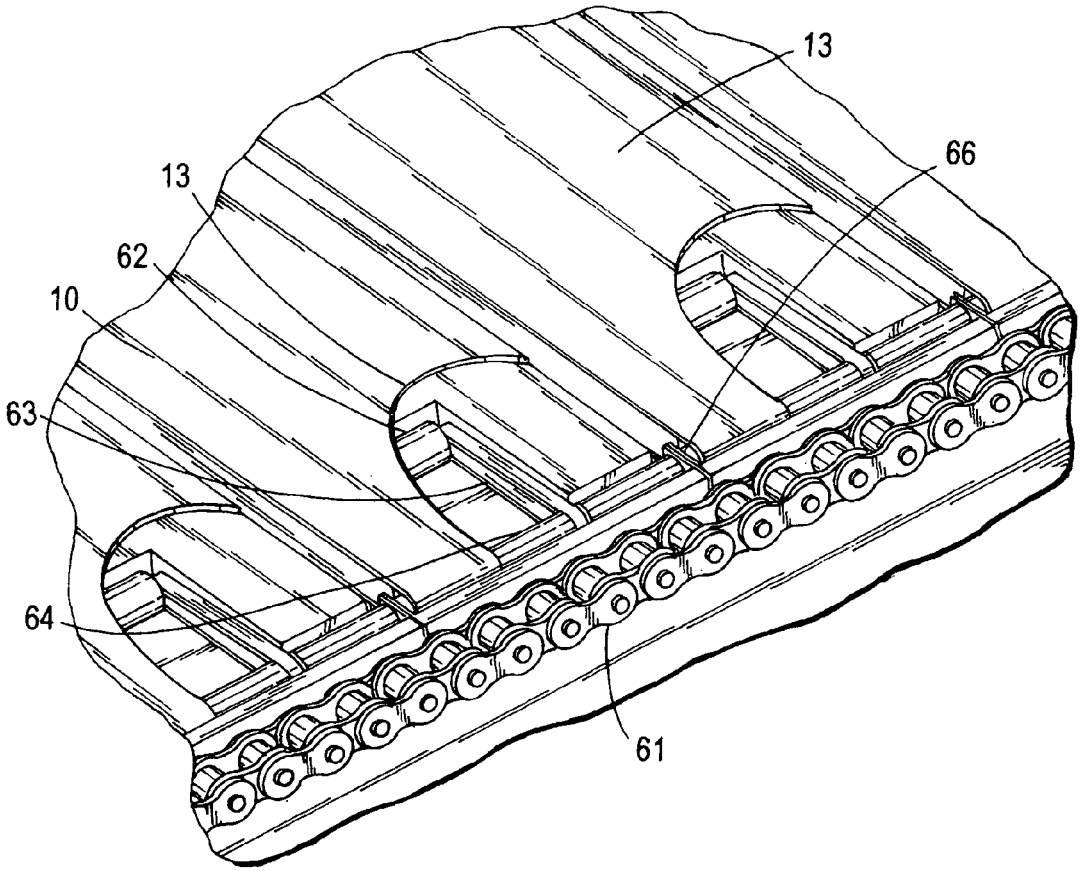
FIG. 8 is a perspective view of a user walking on the active omni-directional surface of the track apparatus and held at the center of the active surface by a middle waist harness.

Individual transverse belt 13 can be driven by its own motor employing couplings. Rather than actuate all transverse belts 13 together with a single servo-motor, each individual belt 13 may have its own small electric motor 62. Transverse belts 13 may be linked at an end roller rotary axis employing the aforementioned coupling-spline. By this means, motors may share power with adjacent units and the individual motors within units may be made smaller. In addition, not every transverse belt 13 may need a motor. Consequently, motors may be installed in every other unit, or fewer, thus saving weight and cost. FIG. 8 shows one configuration of linked, motorized transverse belts 13. A transverse belt 13 sits adjacent to others and is driven in one axis by a chain 61 or other linear actuation means. The belt 13 is driven by a small motor 62 that connects through a drive belt 63 with the end roller 64. A flexible, sliding coupling 66 connects end rollers 64 so that all motors drive adjacent belt 13 thus combining their power.

ODT Placed on a Motion Platform to Simulate Slope and Steps

Walking up and down hills and steps is a common experience in the real world. Besides the force-feedback harness, the surface of the ODT itself may be tipped by placing the entire device on a motion platform. Motion platforms of a suitable type are available commercially from such companies as Moog or MTS Systems Corporation.

Novel Applications

Haptic Feedback for Sitting

In the hierarchy of haptic sensing, the ground comes first. The ODT covers that. Next in the hierarchy comes sitting, with force feedback to the hind quarters. The invention includes the improvement of a moveable sitting surface that comes into play in coordination with a sitting surface in the virtual scene. Such a surface permits a user to observe a chair or wall in the virtual environment, and actually sit on its real, physical corollary.

Haptic Feedback for Swordplay

Figure 11:
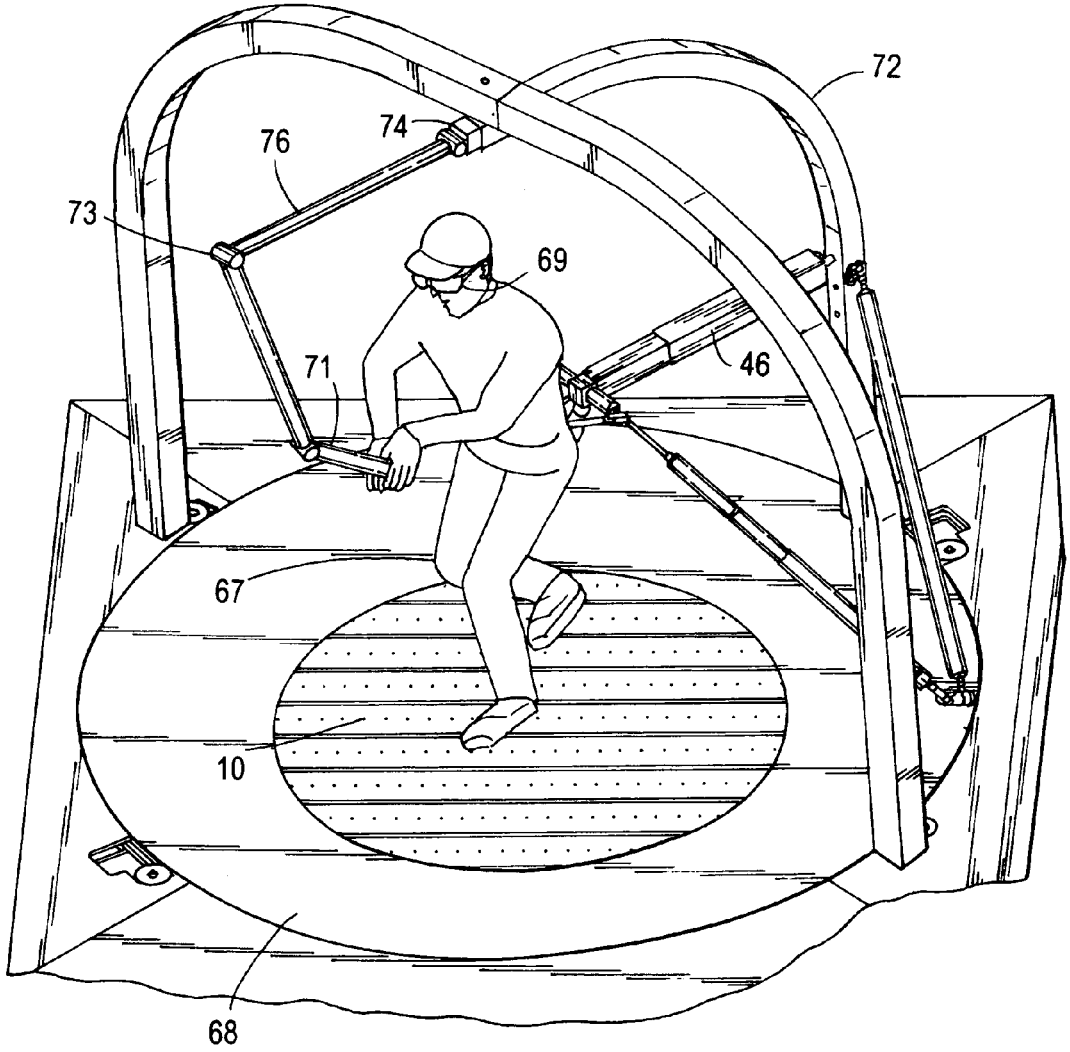
FIG. 11 is a perspective view of a section of the active surface with parts of the transverse belts broken away to show the motor drives for the transverse belts.

For fans of the middle ages fantasy worlds and the sword-swinging adventure games, the inertial frame can be instrumented with a sword hilt or sword analog that has its own servo motors to provide the appropriate feedback forces. The hilt end is controlled by the user; force feedback to the user is controlled by sword mass and by the sword's interaction with the virtual environment. For example, a sword clanging against another sword would provide the user with a "thunk" feeling, and the sound of metal on metal. Such a feedback device is depicted in FIG. 11. In it we see the gamer 67 navigating on the omni-directional surface of track assembly 10, surrounded by the rotary frame 68 and mounting points, which are slaved to his rotary position. His vision is determined by simulator input into the head-mounted display 69. He observes and feels interaction with a sword 71, but he is actually holding a robotic element that feels like a sword. The sword hilt is attached to user ground of the canopy rail through a series of links 73, 74 and actuators 76.

Haptic Feedback for Gunplay

Many training simulator manufacturers, including FATS, AIS-SIM, and IES Interactive Training employ a combination of firearm with video display means. The training weapon typically employs some means of simulating recoil, which is a class of haptic feedback. A variety of weapon types with haptic feedback can be held by the user in the current invention. These can be held freely without any attachment to outside mounts; more typically they can be attached to the moving user frame. Non-attached weapons might have electrical or pneumatic attachments, and non-contact position sensing means. Attached weapons may use servo-motor actuation to provide the sensation of mass, shape, and recoil, or employ pneumatic feed lines.

Haptic Feedback for Physical Interaction with Another Human

As described by D. E. E. Carmein in U.S. Pat. No. 5,490,784 "Virtual Reality System with Enhanced Sensory Apparatus," the immersed user may experience physical contact with a like-immersed user in a remote simulator. The means for mutual physical contact is a mechanical analog for the physical body part that each user wishes to share or experience. If two immersed users wish to hold hands, for instance, each iPlane user frame will contain a robot hand that is slaved to the equivalent hand motion of the remote user. If the distal user reaches out to touch the face of the proximal user, the proximal robotic hand will physically reach up and touch the face of the user. The proximal user sees a virtual hand, feels a real hand, and can respond appropriately. At the same time, the remote user can receive force feedback signals provided by the force-sensor-laden robotic hand. In order to feel these forces, the users' hands must be instrumented with a force feedback glove. The optimal force-feedback glove will have a mechanical ground to the user frame so that proper forces may be applied from outside the user's body. The hand will be a good first choice for initial applications. Other body parts or even whole bodies may be likewise constructed according to developing market demand. It is not necessary for the distal human to be a real person. An "Artificial Intelligence" (AI) can be used to drive appropriate responses. These responses may be used to power the haptic devices.

Telepresence Using ODT Interface

Telepresence is generally defined as coupling a proximal user's senses such as sight and sound to a remote sensing device. Employing the ODT, remote coupling may also include a linked ground plane. That is, by indexing the surface of the ODT to the distal plane, with the user's velocity linked to the velocity of the remote device, the user may power the direction and velocity of the remote device by simply walking around. To steer the remote, one walks, rather than pushing a joystick, to grasp, one grasps, rather than operating in 3-space with keyboard arrows and push buttons. Besides a 1:1 mapping to human sensory input, the remote may be used to add capabilities outside normal human ability, but fully controllable within the scope of normal human abilities. Examples of such extensions are 1) extension of vision in the infrared, 2) strength amplification, or 3) armor plating. A more exotic application would be to map the control scheme to devices that are much larger or much smaller than the human. For example, a remote device may be large enough to lift an automobile, or small enough to walk inside the rubble of a collapsed building. The user may be linked additionally by haptic devices attached to other body parts, such as the hands and forearms. A system such as this may be used to power anthropomorphic robotic devices with the ability to influence remote environments. For example, a feedback arm can be mounted to the rotary base in the user's inertial frame. This arm can then provide an interface to a robotic arm on the remote.

Because telepresence maps remote capabilities to a proximal and safe user, the remote device may accomplish tasks in dangerous or difficult to access places. A telepresent robot may walk with ease into a raging inferno, an atmosphere with no oxygen, a nuclear reactor environment with lethal radiation levels, underwater, or through a hail of bullets. The "driver" of the task-at-hand may focus on the task rather then the environment. By mapping the remote device's functions to normal human activity, remote tasks can be accomplished by less trained personnel or with generally greater efficiency. Or tasks can be accomplished in locations or at scales that are not accessible to humans.

Physical and Psychological Rehabilitation

Currently at least two companies have developed harness-based systems to diagnose and rehabilitate individuals with neurological and spinal deficits. These systems could also be employed to train use of artificial limbs. The current invention is an improvement over the state-of-the art for harness-based rehabilitation. Besides providing omni-directional motion, an advantage over a linear treadmill solution, or one which requires a parking lot or gym for wide-ranging freedom, the ODT plus simulation solution provides greater motivation and incentive to the prospective patient by generating a virtual environment of interest. Such a virtual environment can be constructed to excite and motivate the patient. For instance, the simulation could be the layout of the patient's own home, or it could put them into a competitive simulation of a decathlon sprint. Numerous labs have shown the usefulness of virtual reality therapy for treating phobias (6) as well as post-traumatic stress disorder. The more real the simulation, the better the treatment outcome. ODT-based simulation is a real as it gets; we expect optimal outcomes for treatment therapies based on this technology.

ODT-Based Simulator as Cornerstone of Virtual Business—Infrastructure and Integrated Business Units To the extent that an employee's function is information based, substantial portions of paid work can take place through a computer interface. Bricks and mortar are not required. An ODT-based simulator, especially one with seating capability, can serve as the physical basis for a fully or partially virtual physical plant. Management and employees can reside within a virtual space. The corporate edifice can be as large and luxurious as the bits will allow. Individuals networked in thus can be as physically separate as desired, yet physically seem to work from the same location. Furthermore, standard corporate functions may be integrated with the virtual environment. Such functions include but are not limited to accounting, inventory control, purchasing, human resources, legal, tracking employee activity, cost center grouping, control of instrumented processes, engineering design, and architectural design. The virtual elements of the corporation can be made transparent to a physical plant in two ways. Most simply, an employee can leave the simulator and physically interact with the plant. Alternatively the company can use telepresence as described above to monitor human activities. A complete and profitable company may minimize its bricks and mortar investment by employing a corporate vehicle of this type, and may be able to leverage special elements of the virtual environment to further enhance profitability by doing things only possible in the digital domain. Examples include immersive design, simulator-based sales and marketing, product studies, enhanced telecommuting and related employee satisfaction. An example of the above may be observed in the on-line world wherein companies like IBM are exploring the business applications of immersive virtual worlds.

ODT-Based Simulator Based Sports: Goal Line (or Goal Plane) and Hoop Type

Of the most popular sports such as basketball, football, or soccer, the object of the game is for one of two teams to move an object over a goal line or through a hoop. Once the ODT simulator is instrumented for free-body flight, these sports can be duplicated in 3-space. Games can be broken down into functions:

Carrying Functions:
Foot
Hand
Group
Tool (stick, bat, club)
Point Score Function:
Line
Hoop
Hole
Team Participation Function:
Simultaneous team scoring effort
Individual scoring effort (baseball, cricket)
Individual as team (golf, billiards, tennis)
Time Functions:
Continuous (billiards)
Segmented by play or terrain (golf)
Segmented by rules (football, soccer)
Ball Handling Functions:
Ball is passed between specialized team mates
Ball is handled preferably by one team mate
Ball is put into reciprocal play until one side loses control (tennis)

In 3-space, the playing field becomes a playing volume rather than a playing field. The goal line becomes the goal plane. The hole can take several orientations, or can be moved around as a function of a game rule while the game is playing. For mass consumption, the 3D analogs of the three most popular sports: soccer, American football, and basketball are applicable to the invention.

Persistent Personality Artificial Intelligence (AI) Agent

An ODT-based virtual environment not only sends information to the user, it also extracts information from it. Highly instrumented simulators will extract huge amounts of physical data through recording of physical motion, video texture and body surface terrain, posture, and response to various types of stimulate. Not only the physical being, but also the being's response to and interaction with a wide variety of virtual environments can be recorded and analyzed. One output of this data set is a potentially a formalized data group that records the essence of an individual both in space and time. Certainly fixed data can be played back and be observed by others. Even further, the data can be analyzed for traits, and those traits reproduced in a synthetic character made to resemble the original person. As AI technology advances, these character inputs can be synthesized into digital entities that mimic and preserve the essential nature of the original human. Over time, as this model evolves and improves, the "ancestral AI" will enjoy a high degree of real overlap with the original character. Thus recorded, said AI can be visited by successive generations. As long as the bits are kept alive, the AI personality will persist.

Johnson, et al. in U.S. Pat. No. 6,301,582 describe persistence in the software environment. A persistent AI is another software class.

Design: Mechanical or Architectural

Computer-aided design (CAD) typically occurs using a computer at the desktop. Using the ODT-based simulator, design can occur in whole or in part within the virtual world itself. Using tracked fingers or design devices like a wand, an immersant can draw line, arcs, circles, extrude or sweep solids, drill holes, add/subtract Booleans, integrate components from libraries, and so on. What is more, the designer can experience the design from within the design while it is being built. This point is most clear with architectural design where the architect can be in the building as it forms. Mechanical designers can shape steel like clay, and feel its relative weight using haptic feedback.

Simulator-Based Living Unit

Figure 12:
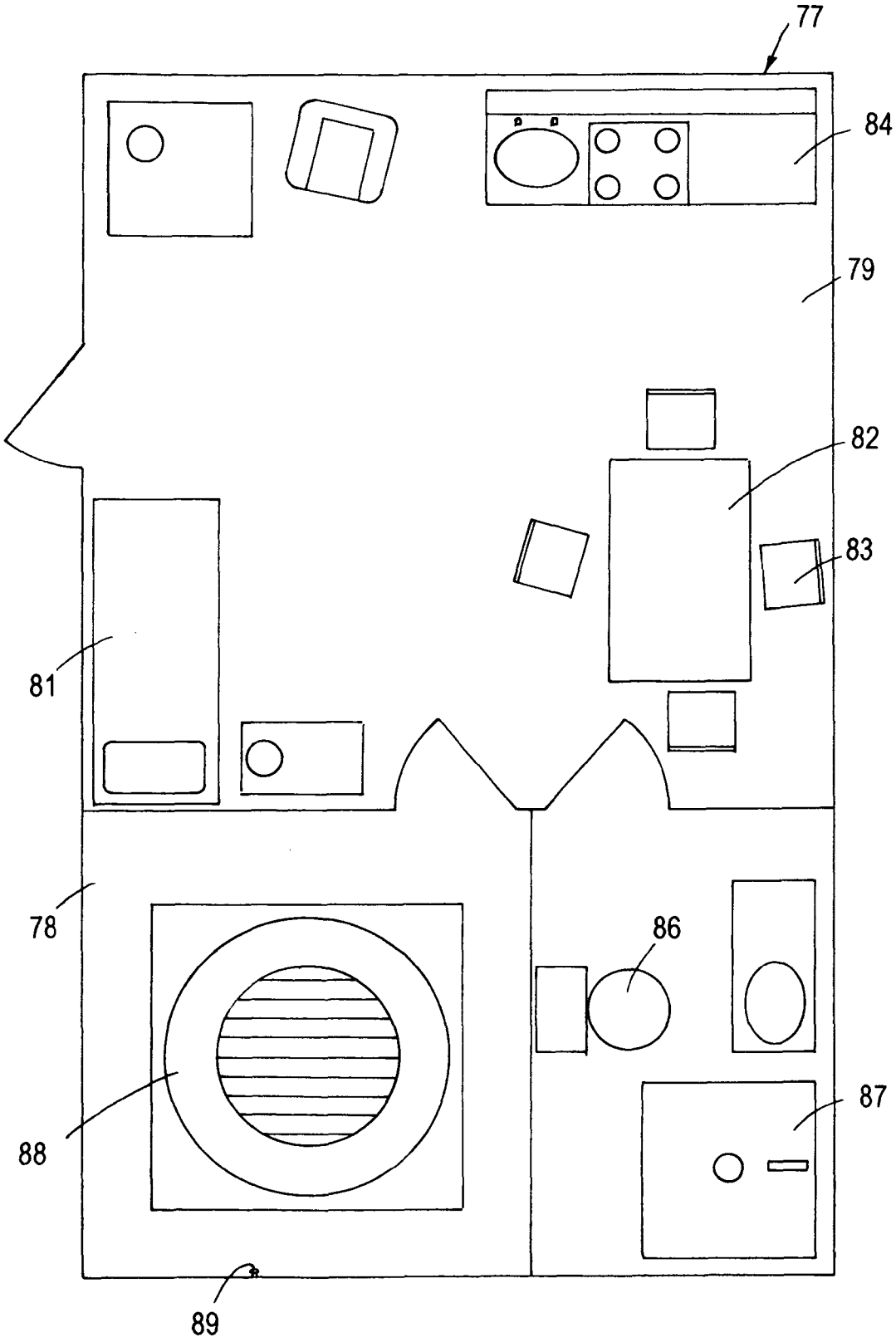
FIG. 12 is a diagram of an omni-directional treadmill simulator in a user's living environment.

We can combine an ODT-based simulator with a living unit and use the simulator to extend the virtual portion of the home, as depicted in FIG. 12. An efficiency apartment 77 might have a simulator room 78 and minimal real living facilities. When the inhabitant enters the simulator, s/he sees a simulation of their real apartment. When they turn the other way, they might see any living space they choose, on any virtual shoreline or mountain ridge that can be digitally designed. In this space they can entertain on-line friends from all over the world. In FIG. 12 we see the efficiency living unit 79 with all the basic facilities such as bed 81, tables 82, chairs 83, food preparation devices 84, and toilet 86 and shower 87. We also see a room 78 dedicated to the ODT simulator 88. On the wall opposite the entry door to the simulator room is a doorknob 89 attached to the wall. Said doorknob 89 may be associated with a cosmetic door that leads nowhere. When the apartment occupant enters the simulator, s/he immediately sees exactly the same room as they did when they entered. If they use the ODT to walk back into their apartment, they might see exactly the same items as in their real apartment. But if they turn and virtually walk towards the wall with the false door, they may employ the haptic equivalent of a doorknob to gain entry to their virtual home. From there, the complexity of the home and its environment are limited only by human imagination. What is unique is that the living unit 79 is constructed with the intent of providing extended virtual space. These units can provide the real physical comfort while consuming a minimum of physical resources. At the same time they may provide the psychological comfort of a luxurious living space along with some unique social status. As well, there may be advantages to the psychological continuity of having the virtual home blend seamlessly with the real home.

Real-Time Interactive Media

Activities conducted within a simulation are observable in real-time as well as recordable. They are observable because of the system's potential ability to capture part or all of a user's motion through the use of a motion capture system. Motion data can be captured and transmitted for real-time viewing or stored for later viewing. A themed simulation environment can be constructed in which the participants engage in structured or scripted interaction. Thus, it is possible to assemble a television show or movie in cyberspace. Said show or movie could be scripted, it could be unscripted, like a hosted show, it could be games or competitions. An audience could watch that show or movie just as we observe actors or players on sets today. A further variation of the above real-time interactive media is to include some portion of the audience in the simulation. A person with a home-based simulator could be just as much a part of the virtual set as any of the actors in Los Angeles or New York. It is possible to have multiple "shows" mining simultaneously, with as many actors and audience-participants as can be reasonably directed and contained. Of course, there is no upper limit to the audience.

While there has been shown and described preferred embodiments of the omni-directional treadmill belt track assembly and its applications, it is understood that changes in materials and structures can be made by persons skilled in the art without departing from the invention.

The invention claimed is:

1. A track assembly for an omni-directional treadmill comprising: a plurality of transverse endless belts, transverse supports for the transverse endless belts and wherein the endless belts are located in adjacent side-by-side positions, said plurality of transverse endless belts having a combined user surface for supporting a user walking or running thereon, drive couplings connecting adjacent transverse endless belts whereby all of the transverse belts are simultaneously moved in the same selective transverse direction which is transverse to a longitudinal direction of the track assembly, a first drive mechanism operable to selectively move all of the transverse belts in the same transverse direction, said first drive mechanism includes a plurality of omni-wheels located in driving engagement with the transverse belts operable to move all the transverse belts in selective transverse directions, and a drive device for rotating the omni-wheels about a longitudinal axis thereby moving the transverse belts in the selected transverse direction, endless longitudinal loop members connected to the transverse supports for the transverse endless belts, longitudinal rails supporting the endless longitudinal loop members and transverse supports for movement in selective longitudinal directions, a second drive mechanism operable to move the loop members in selective longitudinal directions, and a control responsive to the user on the user surface to control the operation of the first and second drive mechanisms thereby controlling the omni-directional user movement to conform with the directional orientation of the user on the user surface.

2. The track assembly of claim 1 wherein: the transverse supports for each transverse belt includes end members engageable with the rails to support the end members and connectors securing the end members to the loop members.

3. The track assembly of claim 2 wherein: the connectors are pairs of pins securing the end members to the loop members.

4. The track assembly of claim 2 wherein: the endless longitudinal loop members are endless link chains and a pair of pins securing the chains to the end members.

5. The track assembly of claim 1 wherein: the drive couplings comprise U-joints having spline sections to allow for relative movements between adjacent transverse supports for the transverse belts at opposite longitudinal ends of the track assembly.

6. The track assembly of claim 1 wherein: the drive couplings comprise CV joints for allowing relative movements between adjacent transverse supports for the transverse belts at opposite longitudinal ends of the track assembly.

7. The track assembly of claim 1 wherein: the drive couplings comprise flexible coils for allowing relative movements between adjacent transverse supports for the transverse belts at opposite longitudinal ends of the track assembly.

8. The track assembly of claim 1 wherein: each omni-wheel includes circumferentially spaced rotatable barrels.

9. The track assembly of claim 1 including: a longitudinal shaft drivably connected to the omni-wheels and said drive device being connected to the shaft to rotate the shaft thereby rotate the omni-wheels and move the transverse belts.

10. The track assembly of claim 1 wherein: the first drive mechanisms includes an electric motor operatively connected to a transverse belt to drive the belt in selective transverse directions.

11. The track assembly of claim 1 in combination with a harness apparatus attachable to a user on the active surface to provide functions, such as force control, position control, haptic wholebody feedback, free-body flight and safety.

12. The track assembly of claim 1 in combination with an immersive simulation apparatus to provide haptic feedback.

13. The track assembly of claim 1 in combination with a rigid frame for physical grounding and a user's rotary frame.

14. The track assembly of claim 1 in combination with an immersive simulation apparatus to provide haptic feedback and a user's living environment.

15. The track assembly of claim 1 in combination with a harness apparatus attachable to a user, and a four bar linkage attaching the harness apparatus to an actuator assembly and a rigid canopy bar fastened to the actuator assembly operable to retain the user generally in the center of the track assembly.

16. The track assembly of claim 1 in combination with virtual reality device responsive to movements of the user on the user surface, said virtual reality device including a visual display mountable on the user's head for displaying visual images.

17. The track assembly of claim 1 in combination with a remote sensing device for extracting sensory information from a real remote source and conveying it to the senses of the user.

18. The track assembly of claim 1 in combination with a user harness apparatus operable to diagnose and rehabilitate individuals with neurological and spinal deficits.

19. An apparatus for allowing a user to move in any arbitrary direction comprising: a track assembly having a frame with longitudinal rails, a plurality of transverse endless belts, supports for the transverse endless belts, said supports locating the endless belts in side-by-side positions, said plurality of transverse endless belts having a combined upper user surface for supporting a user, drive couplings connecting opposite ends of adjacent transverse endless belts whereby all of the transverse belts are simultaneously moved at the same speed in the same selective transverse direction, said transverse direction being transverse to the longitudinal direction of the track assembly, a first drive mechanism operable to move all of the transverse belts in the same transverse direction, said first drive mechanism including a plurality of omni-wheels located in driving engagement with the transverse belts operable to move all of the transverse belts in selective transverse directions, and a drive device for rotating the omni-wheels about a longitudinal axis thereby simultaneously moving the transverse belts in the transverse direction, said supports having opposite end members supported on the rails for longitudinal movement along the rails, endless longitudinal link chains located adjacent to the end members, connectors attaching the chains to the end members, a second drive mechanism operable to move the link chains in selective longitudinal directions, and a control associated with a user on the user surface to control the operation of the first and second drive mechanisms.

20. The apparatus of claim 19 wherein: the connectors are pairs of pins securing the chains to the end members.

21. The apparatus of claim 19 wherein: the drive couplings comprise U-joints having spline sections to allow for relative movements between adjacent supports for the transverse belts at opposite longitudinal ends of the track assembly.

22. The apparatus of claim 19 wherein: the drive couplings comprise CV joints for allowing relative movements between adjacent supports for the transverse belts at opposite longitudinal ends of the track assembly.

23. The apparatus of claim 19 wherein: the drive couplings comprise flexible coils for allowing relative movements between adjacent supports for the transverse belts at opposite longitudinal ends of the track assembly.

24. The track assembly of claim 19 wherein: each omni-wheel includes circumferentially spaced rotatable barrels.

25. The apparatus of claim 19 including: a longitudinal shaft drivably connected to the omni-wheels and said drive device being connected to the shaft to rotate the shaft thereby rotate the omni-wheels and move the transverse belts.

26. The apparatus of claim 19 wherein: the first drive mechanisms includes an electric motor operatively connected to a transverse belt to drive the belt in selective transverse directions.

27. The apparatus of claim 19 in combination with a harness apparatus attachable to a user on the active surface to provide functions, such as force control, position control, haptic wholebody feedback, free-body flight and safety.

28. The apparatus of claim 19 in combination with an immersive simulation apparatus to provide haptic feedback.

29. The apparatus of claim 19 in combination with a rigid frame for physical grounding and a user's rotary frame.

30. The apparatus of claim 19 in combination with an immersive simulation apparatus to provide haptic feedback and a user's living environment.

31. The apparatus of claim 19 in combination with a harness apparatus attachable to a user, and a four bar linkage attaching the harness apparatus to an actuator assembly and a rigid canopy bar fastened to the actuator assembly operable to retain the user generally in the center of the track assembly.

32. The apparatus of claim 19 in combination with virtual reality device responsive to movements of the user on the user surface, said virtual reality device including a visual display mountable on the user's head for displaying visual images.

33. The apparatus of claim 19 in combination with a remote sensing device for extracting sensory information from a real remote source and conveying it to the senses of the user.

34. The apparatus of claim 19 in combination with a user harness apparatus operable to diagnose and rehabilitate individuals with neurological and spinal deficits.

* * * * *